US010556427B2

(12) United States Patent
Franck

(10) Patent No.: US 10,556,427 B2
(45) Date of Patent: Feb. 11, 2020

(54) METHOD FOR ACTUATING AN INK-JET PRINT HEAD

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 15/743,699

(22) PCT Filed: Jul. 11, 2016

(86) PCT No.: PCT/IB2016/000986
§ 371 (c)(1),
(2) Date: Jan. 11, 2018

(87) PCT Pub. No.: WO2017/009705
PCT Pub. Date: Jan. 19, 2017

(65) Prior Publication Data

US 2019/0054741 A1 Feb. 21, 2019

(30) Foreign Application Priority Data

Jul. 13, 2015 (DE) ..... 10 2015 009 117
Jul. 17, 2015 (DE) ..... 10 2015 009 101

(51) Int. Cl.
*B41J 2/045* (2006.01)
*B41J 2/14* (2006.01)

(52) U.S. Cl.
CPC ..... *B41J 2/04581* (2013.01); *B41J 2/04503* (2013.01); *B41J 2/04588* (2013.01);
(Continued)

(58) Field of Classification Search
CPC ..... B41J 2/04581; B41J 2/14201; B41J 2/04595; B41J 2/04503; B41J 2/04588; B41J 2/04593
See application file for complete search history.

(56) References Cited

U.S. PATENT DOCUMENTS

2007/0097163 A1 5/2007 Shingyohuchi et al.

FOREIGN PATENT DOCUMENTS

JP 2002 086765 3/2002
JP 2002086765 A * 3/2002
(Continued)

OTHER PUBLICATIONS

Machine Translation of Tsukamoto (JP 2012 045797 A), "Driving Device and Driving Method of Ink Jet Head, and Ink Jet Recording Apparatus", Fujifilm Corp (Assignee), Paragraphs 0049, 0086, 0190 (Year: 2012).*

(Continued)

*Primary Examiner* — Lisa Solomon
(74) *Attorney, Agent, or Firm* — Pandiscio & Pandiscio

(57) ABSTRACT

The invention relates to a method for actuating an inkjet print head, comprising at least one printing system having a nozzle on the side of an ink chamber which faces a substrate to be imprinted, and which is delimited at least in areas, preferably in its area facing away from the print substrate, by a diaphragm that is movable away from the ink chamber by electrically actuating a piezo element that is mechanically coupled to the diaphragm, so that ink is drawn into the ink chamber from a reservoir, and the diaphragm is movable into the ink chamber so that an ink drop is ejected from the ink chamber through the nozzle, wherein the printing system made up of the ink chamber, diaphragm, piezo element, and the electronic control system thereof represents an oscillatable structure which, when actuated at high energy, is excited to oscillate at a natural frequency $f_{res}$ that exhibits resonance; i.e. the oscillation with the period $T_{res}=1/f_{res}$ undergoes little or no attenuation, and wherein the brightness of a pixel to be printed is varied in that, for each pixel, a sequence of multiple ink drops is ejectable in succession from the same nozzle at a time interval of $T_{drop}=1/f_{drop}$, and (Continued)

energy is only introduced into the printing system via the actuation signal precisely when an ink drop is actually to be ejected.

13 Claims, 6 Drawing Sheets

(52) U.S. Cl.
CPC ..... *B41J 2/04593* (2013.01); *B41J 2/04595* (2013.01); *B41J 2/14201* (2013.01)

(56) References Cited

FOREIGN PATENT DOCUMENTS

| | | | |
|---|---|---|---|
| JP | 2012 045797 | | 3/2012 |
| JP | 2012045797 A | * | 3/2012 |

OTHER PUBLICATIONS

Machine Translation of Ikeda et al. (JP 2002 086765 A), "Ink Jet Head and Ink Jet Recording Apparatus", Matsushita Electronic Ind Co LTD (Assignee), Paragraph 0058 and Fig. 12 (Year: 2002).*
IP.com search (Year: 2018).*
IP.com search (Year: 2019).*

* cited by examiner

METHOD FOR ACTUATING AN INK-JET PRINT HEAD

REFERENCE TO PENDING PRIOR PATENT APPLICATIONS

This patent application claims benefit of International (PCT) Patent Application No. PCT/IB2016/000986, filed 11 Jul. 2016 by Jan Franck for METHOD FOR ACTUATING AN INK-JET PRINT HEAD, which claims benefit of: (i) German Patent Application No. DE 10 2015 009 117.4, filed 13 Jul. 2015 and (ii) German Patent Application No. DE 10 2015 009 101.8, filed 17 Jul. 2015, which patent applications are hereby incorporated herein by reference.

FIELD OF THE INVENTION

The invention is directed to a method for actuating an inkjet print head, comprising at least one printing system having a nozzle on the side of an ink chamber which faces a substrate to be imprinted, and which is delimited at least in areas, preferably in its area facing away from the print substrate, by a diaphragm that is movable away from the ink chamber by electrically actuating a piezo element that is mechanically coupled to the diaphragm, so that ink is drawn into the ink chamber from a reservoir, and the diaphragm is movable into the ink chamber so that an ink drop is ejected through the nozzle, wherein the printing system made up of the ink chamber, diaphragm, piezo element, and the electronic control system thereof represents an oscillatable structure which, when actuated at high energy, is excited to oscillate at a natural frequency $f_{res}$ that exhibits resonance; i.e., the oscillation with the period $T_{res}=1/f_{res}$ undergoes little or no attenuation, and wherein the brightness of a pixel to be printed is varied in that, for each pixel, a sequence of zero, one, two, or more ink drops is ejectable in succession from the same nozzle at a time interval of $T_{drop}=1/f_{drop}$.

BACKGROUND OF THE INVENTION

A known inkjet printing system is illustrated in FIGS. 1 through 4. The external mechanical construction of an inkjet print head 1 is apparent in FIG. 1. The central area of the inkjet print head forms an elongated plate 2 with adjustment and/or fastening holes 3, 4 and/or fastening pins in end areas 5 of the plate 2 on the end-face side.

Situated between these end areas 5 used for adjustment and fastening is a central, preferably thickened portion 6 of the plate 2, where a plurality of nozzles 8 for delivering ink drops in the direction toward the substrate to be imprinted open into the flat side 7 of the plate 2 facing a substrate to be imprinted. In the area of the flat side 7, the middle portion 6 of the plate 2 provided with nozzles 8 may be elevated with respect to the adjoining end areas 5, so that heads 9 of fastening screws protruding beyond the end areas 5 do not contact the substrate to be imprinted.

A mechanism, illustrated in cross section in FIG. 2, extends in the area of the middle portion 6 of the plate 2 on the oppositely situated flat side 10 of the plate 2. It is apparent that a printing system 11 associated with the nozzle 8 is situated behind each nozzle.

Each printing system 11 has its own ink chamber 12, from which only the single nozzle 8 that opens into that location is supplied with ink. This ink chamber 12 is connected to a feeding ink reservoir 14 via an ink channel 13 having a comparatively much smaller cross section; the ink chamber 12 may be refilled through the ink channel 13 after ejecting an ink drop.

Whereas the ink channel 13 opens into the ink chamber 12 from the side, a diaphragm 15 which is fixed, for example clamped, only along its peripheral edge is situated at the side of the ink chamber 12 opposite from the nozzle 8. The movable portion of a piezo element 16 is fastened to the side of the diaphragm 15, in the middle area thereof, facing away from the ink chamber 12, and the piezo element in turn is fixed to a solid rear plate or to a solid rear block 17.

Via a control circuit 18 that is directly connected to the piezo element 16, the piezo element may be excited to undergo contractions or expansions, which are transmitted 1:1 to the connected diaphragm 15 and which therefore increase or decrease the volume within the ink chamber 12.

When the ink chamber 12 becomes larger, ink is drawn from the ink reservoir 14 and into the ink chamber 12; when the ink chamber 12 becomes smaller, an ink drop is ejected from the nozzle 8 when the reduction in volume is sufficiently strong and powerful, i.e., sufficiently great and rapid, so that an ink drop consequently bulging from the nozzle 8 falls off.

FIG. 3 shows that overall, only a few ink reservoirs 14 are provided, preferably only one or two, to which a larger number of ink chambers 12 are in each case connected.

It is apparent in FIG. 4 that the piezo elements 16, from an electrical standpoint, may represent capacitors that charge when connected to a supply voltage 19, in order to cause a mechanical reaction, for example a contraction or expansion; they may also be discharged or recharged to trigger the reverse mechanical reaction, for example by short-circuiting the two electrical terminals of a capacitor or by active application of a different voltage.

The totality of a printing system 11, i.e., its ink chamber 12, diaphragm 15, piezo element 16, and the control circuit 18 form an oscillatable system. The natural frequency $f_{res}$ off this system depends on the geometric design of the printing system 11 and the properties of its components 12, 15, 16, 18. However, the natural frequency $f_{res}$ does not have to be calculated; instead, after triggering an oscillation by means of a sufficiently high-energy actuating signal, the natural frequency may be read off at the electrical terminals of the piezo element 16. At this location a largely undamped oscillation is discernible, whose period $T_{res}$ is inversely proportional to the natural frequency $f_{res}$: $f_{res}=1/T_{res}$.

A measuring circuit for determining this natural frequency $f_{res}$ is quite simple: An active control circuit 18 for a piezo element generates an isolated trigger pulse or a series of trigger pulses with widely spaced time intervals, for example at an interval of one or several seconds. If the signal pattern is so strongly attenuated after emission of the pulse, or in each case a pulse, from the control circuit 18 that the natural frequency oscillation is already dying down within an oscillation period, the connection between the control circuit 18 and the piezo element 16 may be additionally interrupted after a pulse is emitted, or interrupted until the next pulse, so that the piezo element 16 together with the connected mechanical components is in the meantime left on its own and may freely oscillate without appreciable attenuation, so that a plurality of measurable oscillation waves follow one another in succession. In this phase, an electrical voltage in the form of a gradually dying down wave is measurable at the electrical terminals of the piezo element 16, with a frequency that corresponds to the resonance frequency $f_{res}$ of the overall system made up of electrical and mechanical components.

The voltage at the piezo element is dynamically measured or recorded, for example with an oscillograph or a storage oscilloscope, the image display or recording being triggered by the trigger pulse. The period $T_{res}$ of a resonance oscillation may then be read off on the time scale of the oscillograph screen or a stored signal recording, and the resonance frequency $f_{res}$ may be determined therefrom using the formula: $f_{res}=1/T_{res}$.

For variable darkening of a pixel, up to k ink drops may be delivered per pixel:

$$n=0,1,2,\ldots k.$$

The time interval $T_{drop}$ between two successive ink drops may be constant, for example $T_{seq}/(k-1)$, i.e., a portion of the overall image drop sequence $T_{seq}$ or a multiple thereof, in particular:

$$T_{drop}=T_{seq}*(k-n)/(k-1),$$

when n<k ink drops are printed per pixel sequence.

Typically, for each pixel sequence, initially the natural oscillation is excited at the resonance frequency res off the printing system 11 by a signal having a reduced amplitude, and in the period split specified thereby, by means of an appropriately set actuation one ink drop per period $T_{res}$ of the natural frequency is then delivered, in particular in each case approximately in the same phase of the natural oscillation. This entails an actuation in such a way that, in any case for more than one ink drop per pixel sequence, the following applies:

$$T_{drop}=T_{res}.$$

The printing system is thus subordinate to the natural frequency of the system; this natural frequency, in a manner of speaking, forms the clock pulse in which printing takes place. However, it has been shown that this pulse frequency $f_{res}$ is comparatively comparatively slow, and therefore limits the printing speed. As a result, in turn the number of ink drops per image sequence in practice is reduced to the greatest extent possible in order to keep the printing speed within acceptable limits; however, this results in reduced printing accuracy, since each ink drop must then have a comparatively large volume, and therefore fine gradations are not possible.

SUMMARY OF THE INVENTION

The disadvantages of the described prior art result in the object of the invention, to refine a generic method in such a way that the printing speed may be increased, and/or at the same or improved printing speed the gradations in color brightness may be refined.

This object is achieved in that energy is only introduced into the printing system via the actuation signal precisely when an ink drop is actually to be ejected.

Thus, by dispensing with triggering the natural oscillation prior to a pixel sequence, the printing system at that point is initially in a neutral state. The first drop is printed with a large control amplitude, but with a shortened pulse duration, in order to minimize the energy introduced into the system, so that no, or only a minimum, excitation takes place at the natural frequency, and the printing system therefore also does not post-oscillate after the first ink drop, but instead once again comes to rest within less than one period $T_{res}$ of the natural oscillation, preferably even within less than one-half the period $T_{res}$ of the natural oscillation. This opens up the possibility for emitting the trigger pulse for the next ink drop within a fraction of this period $T_{res}$. Consequently, rhythmical excitations in the clock pulse of the natural frequency $f_{res}$ also do not take place, so that natural oscillation cannot build up in the course of multiple successive trigger pulses. Rather, the printing system returns to the neutral state after each ink drop.

It has proven to be advantageous that the minimum time interval $T_{drop}$ between chronologically sequential print actuating signals is unequal to the oscillation period $T_{res}=1/f_{res}$ of the resonant natural frequency $f_{res}$ of the printing system:

$$T_{drop}\neq T_{res}.$$

It is best to provide a certain safety margin $T_{\varepsilon}=|T_{res}-T_{drop}|\geq 0$ between the two period values $T_{drop}\neq T_{res}$, so that, even in the case of actuating signals following in direct succession, no resonant oscillation is triggered, or that an oscillation possibly initiated by successive actuating signals undergoes sufficient attenuation. Such a safety margin may be defined by $$T_{\varepsilon}=|T_{res}-T_{drop}|\geq\mu*T_{res},$$

where $0<\mu<1$, in particular $\mu=1/5$, or $\mu=1/4$, or $\mu=1/3$.

The invention may be refined in that the minimum time interval $T_{drop}$ between chronologically sequential print actuating signals is equal to or preferably less than three-fourths of the oscillation period $T_{res}=1/f_{res}$ of the resonant natural frequency $f_{res}$ of the printing system:

$$T_{drop}\leq T_{res}/1.33.$$

This corresponds to a value of $\mu=1/4$ for $\mu$.

The invention may be refined in that the minimum time interval $T_{drop}$ between chronologically sequential print actuating signals is equal to or preferably less than two-thirds of the oscillation period $T_{res}=1/f_{res}$ of the resonant natural frequency $f_{res}$ of the printing system:

$$T_{drop}\leq T_{res}/1.5.$$

This corresponds to a value of $\mu=1/3$ for $\mu$.

According to another design rule, the minimum time interval $T_{drop}$ between chronologically sequential print actuating signals is equal to or preferably less than one-half the oscillation period $T_{res}=1/f_{res}$ of the resonant natural frequency $f_{res}$ of the printing system:

$$T_{drop}\leq T_{res}/1.66.$$

This corresponds to a value of $\mu=2/5$ for $\mu$.

According to another design rule, the minimum time interval $T_{drop}$ between chronologically sequential print actuating signals is equal to or preferably less than one-half the oscillation period $T_{res}=1/f_{res}$ of the resonant natural frequency $f_{res}$ of the printing system:

$$T_{drop}\leq T_{res}/1.75.$$

This corresponds to a value of $\mu=3/8$ for $\mu$.

On the other hand, the minimum time interval $T_{drop}$ between chronologically sequential print actuating signals cannot be made arbitrarily small, since otherwise, either successive ink drops would coalesce during their flight, or no ink drops at all would come off the nozzle. Therefore, the following should apply:

$$T_{drop}\geq\nu*T_{res},$$

where $0<\nu<1$, in particular $\nu=1/5$, or $\nu=1/4$, or $\nu=1/3$.

The invention provides, for example, that the minimum time interval $T_{drop}$ between chronologically sequential print actuating signals is equal to or preferably greater than one-third the oscillation period $T_{res}=1/f_{res}$ of the resonant natural frequency $f_{res}$ of the printing system:

$$T_{drop}\geq T_{res}/4.$$

This corresponds to a value of $\nu=1/4$ for $\nu$.

Therefore, the invention provides that the minimum time interval $T_{drop}$ between chronologically sequential print actuating signals is equal to or preferably greater than one-third of the oscillation period $T_{res}=1/f_{res}$ of the resonant natural frequency $f_{res}$ of the printing system:

$$T_{drop} \geq T_{res}/2.5.$$

This corresponds to a value of $\nu=1/3$ for $\nu$.

Further advantages result from the minimum time interval $T_{drop}$ between chronologically sequential print actuating signals being equal to or preferably greater than four-tenths of the oscillation period $T_{res}=1/f_{res}$ of the resonant natural frequency $f_{res}$ of the printing system:

$$T_{drop} \geq T_{res}/2.5.$$

This corresponds to a value of $\nu=2/5$ for $\nu$.

Based on the above definition, the following must apply for $\mu$ and $\nu$:

$$\mu+\nu \leq 1.$$

Optimal results may be achieved when a subsequent trigger pulse takes place fairly closely to the point in time when a resonance oscillation that is triggered by the preceding trigger pulse has just completed one-half a period, since then, the new trigger pulse is anticyclical with respect to the preceding trigger pulse, and in a manner of speaking counteracts same, i.e., in the ideal case quenches it. This may be optimally achieved by the following dimensioning:

$$T_{drop}=T_{res}/2.$$

In practice, it has been shown that values that deviate slightly herefrom also provide good results:

$$0.4*T_{res}<T_{drop}<0.6*T_{res},$$

or in particular:

$$0.45*T_{res}<T_{drop}<0.55*T_{res}.$$

Such an actuation is thus completely different from that customary in the prior art, in which the energies of successive trigger pulses are superimposed additively; i.e., they further increase a resonance oscillation. In contrast, in the present invention the energies of successive trigger pulses are superimposed subtractively; i.e., they quench each resonance oscillation. In other words, whereas in the prior art resonance oscillations are facilitated, the aim of the invention is to suppress resonance oscillations.

One advantageous side effect of the method according to the invention is that the drop frequency may be at least doubled, and may possibly be increased even further. As a result, multiple drops may be delivered for each pixel.

According to the invention, it is further provided that the size or the volume of an ink drop is not a function of the duration or of other properties of a preceding trigger pulse. In this way, not only multiple ink drops for each pixel, but also even different sizes of drops may be produced.

The sizes or volumes of the ink drops of a pixel sequence to be printed may thus be different and/or independent from one another.

The invention allows a refinement such that the series of different drop sizes is nonlinear. The series may be logarithmic, for example, such as 8:4:2:1. It is clear that, with such a system, drop sizes between a maximum volume $V_{max}$ and a minimum volume $V_{min}$ may be produced, for example $V_{max}=15*V_{min}$. For an ink quantity per pixel of $7*V_{min}$, it would then be necessary to produce one drop each of the sizes $4*V_{min}$, $2*V_{min}$, and $1*V_{min}$; an ink quantity per pixel of $12*V_{min}$ may be produced by one drop each of the sizes $8*V_{min}$ and $4*V_{min}$, and so forth.

The size or the volume of an ink drop may be increased by increasing the amplitude of a trigger pulse. The diaphragm 15 is thus further deflected, and a larger volume of ink is displaced.

Another option for increasing the size or the volume of an ink drop is to increase the overall duration of a trigger pulse or the duration of the plateau phase of a trigger pulse. This makes it possible for a drop that is falling off to pick up a larger quantity of ink.

The size or the volume of an ink drop may also be increased by increasing the duration of the rising and/or falling edge of a trigger pulse. The mechanism is thus given more time to follow an actuating signal, and in addition a larger quantity of ink may be set in motion, which then ultimately falls off in the form of a larger drop.

Lastly, according to the teaching of the invention, in any event for a pixel having an associated color intensity of zero, corresponding to no ink drop, a placeholder signal is emitted which, however, is too weak in its intensity to bring about the triggering of a drop; however, if the color intensity of zero is not associated with a pixel, corresponding to one or multiple ink drops, a nonprinting preliminary signal or intermediate signal is not present either in front of or between the trigger pulses of this pixel sequence. On the one hand, as a result the printing speed is not impaired by unnecessary intermediate signals; on the other hand, no excess energy is consumed, which in particular heats up the print head and may thus result in inaccuracies, and lastly, in the ideal case successive trigger pulses are optimally set with respect to one another in such a way that no additional signals are necessary for the sought suppression of resonant natural oscillations.

BRIEF DESCRIPTION OF THE DRAWINGS

Further features, particulars, advantages, and effects based on the invention result from the subclaims and from the following description of one preferred embodiment of the invention, and with reference to the drawings, which show the following:

DETAILED DESCRIPTION OF THE PREFERRED EMBODIMENTS

The design of the inkjet print head 1 and one of its printing systems 11 has already been described in detail above with reference to FIGS. 1 through 4.

Figure 1B:
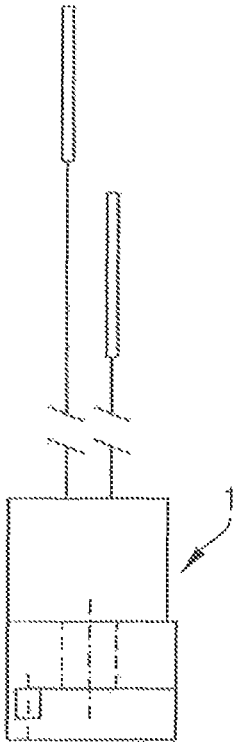
FIGS. 1*a*, 1*b* and 1*c* show various views of an inkjet print head.
Figure 1A:
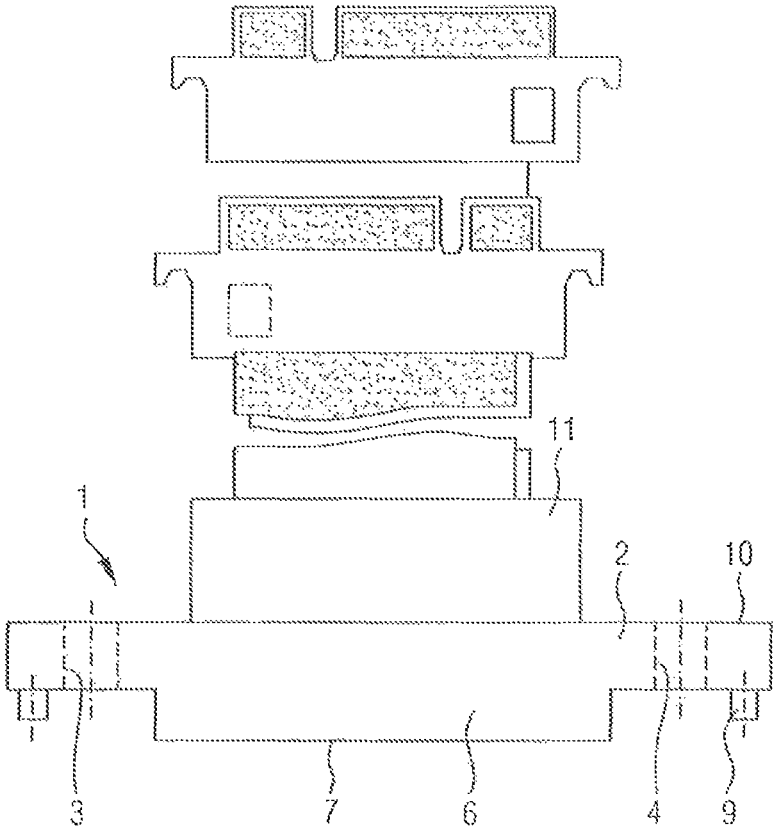
Figure 1C:
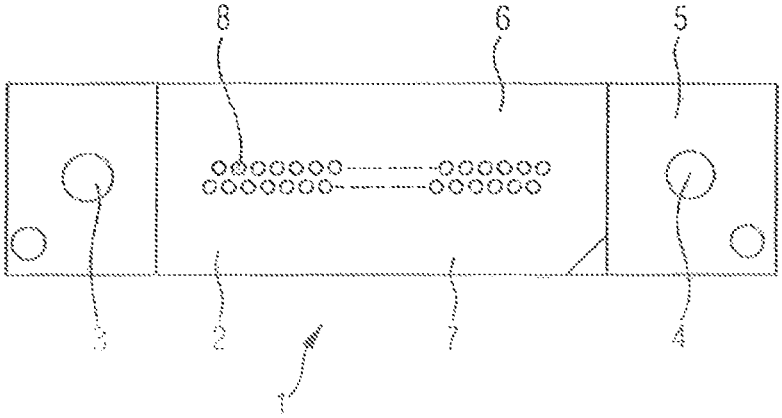
Figure 2:
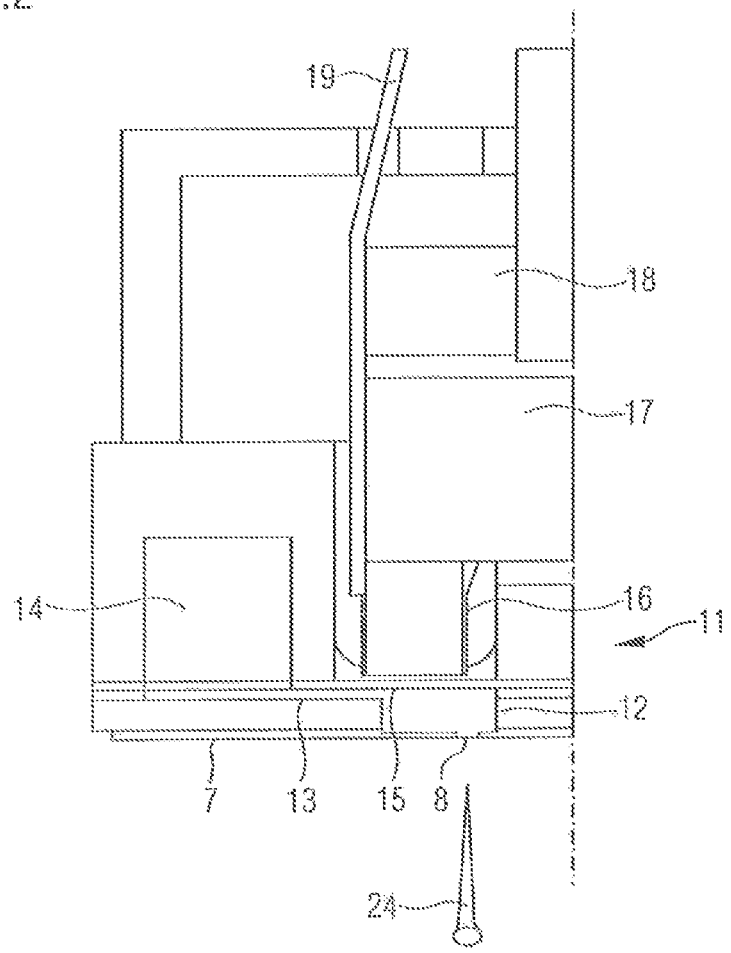
FIG. 2 shows a vertical section of a printing system of the inkjet print head according to FIG. 1.
Figure 3:
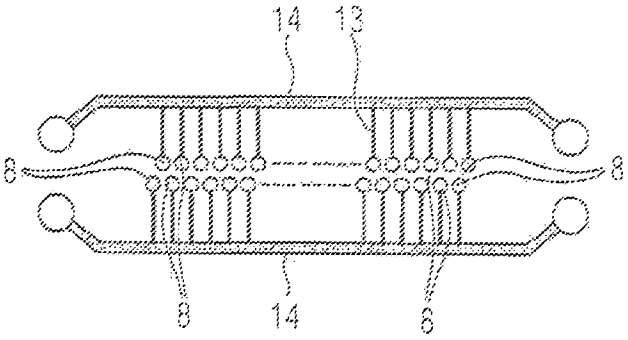
FIG. 3 shows the ink chamber system of the inkjet print head according to FIG. 1, in a schematic illustration.
Figure 4:
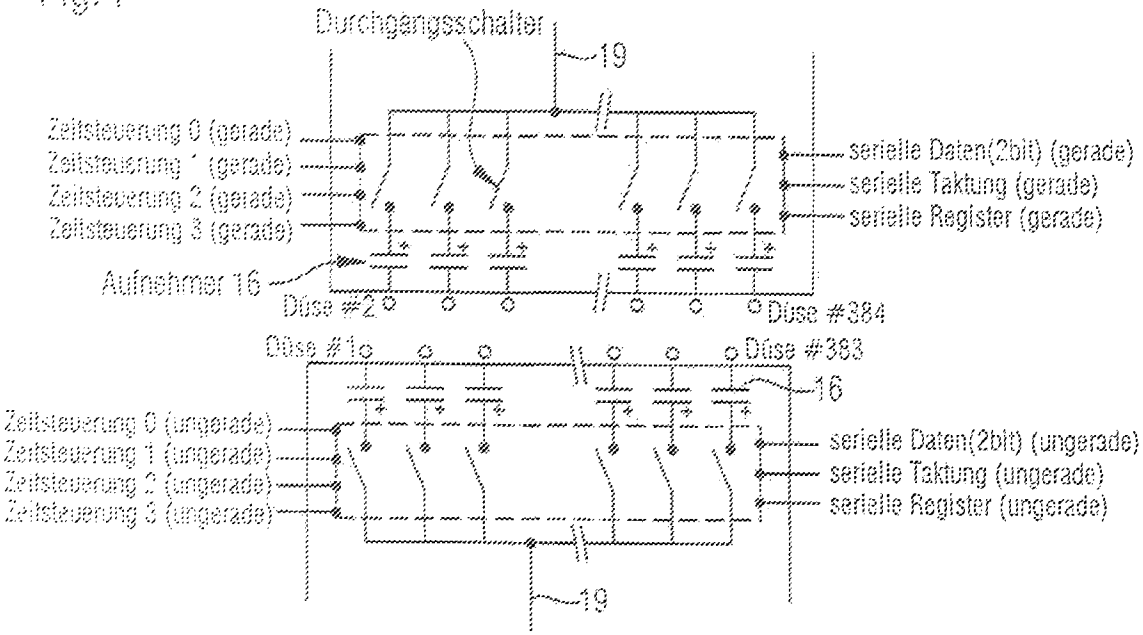
FIG. 4 shows the electronic control system of the inkjet print head according to FIG. 1, in a schematic illustration.
Figure 5:
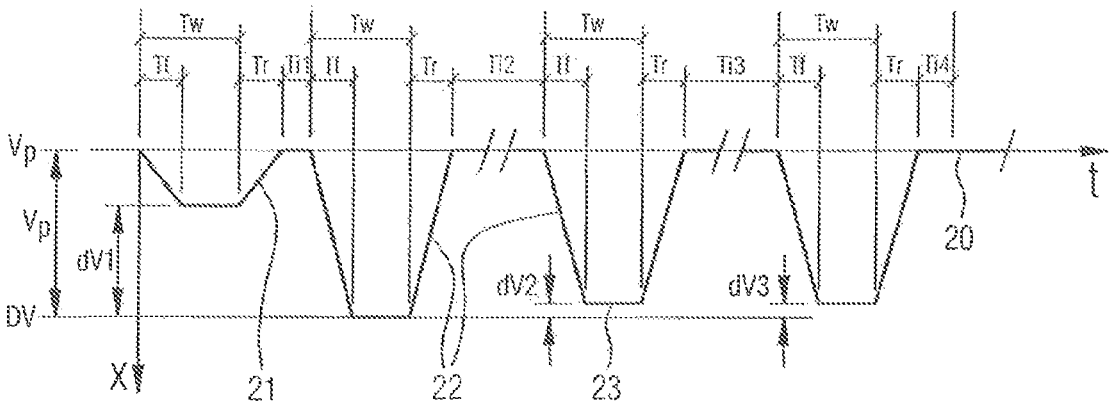
FIG. 5 shows the variation over time of a customary actuating signal for a printing system according to FIG. 1, and the deflection signal of the piezo element proportional thereto.

The customary mode of operation of such a printing system is illustrated in FIG. 5. The deflection x or −x of the portion of the piezo element 16 coupled to the diaphragm 15 is shown as a graph 20 in the figure. The upper line of the signal corresponds to a type of zero position of the piezo element 16 or of the diaphragm 15. The ink chamber 12 has just been completely filled with ink. Plotted at the bottom is a deflection of the piezo element 16 or of the diaphragm 15 away from the ink chamber 12, which results in an increase in the volume V in the ink chamber. This increase in volume ΔV is approximately equal to the deflection Δx of the diaphragm 16 multiplied by the base surface area F of the ink chamber 12 or of the diaphragm 16 which completely spans the ink chamber:

$$\Delta V = Q^* \Delta x.$$

The displacement −x is illustrated along the ordinate in FIG. 5; i.e., a displacement of the diaphragm 16 toward the ink chamber 12 is plotted at the top. Thus, as the graph 20 ascends, the diaphragm 16 approaches the ink chamber 12 by the value |Δx|, thus reducing the volume V by the quantity |Δ|=Q*|Δx|; i.e., ΔV<0. In other words, −Δx, corresponding to −ΔV, is plotted at the top.

The time t is plotted along the abscissa in FIG. 5.

A first pulse 21 begins at t=0. The deflection 21 in FIG. 5 points downwardly; i.e., Δx becomes larger, and the ink chamber volume V thus increases, and ink in a quantity ΔV is drawn into the ink chamber 12.

However, the deflection 21 does not take place to the extent that the drawn-in volume ΔV is less than the volume of a drop $V_{drop}$:

$$\Delta V < V_{drop}.$$

Consequently, when the diaphragm 16 subsequently swings back, no ink drop is pressed through the nozzle 8, and instead the ink surface only bulges outwardly through the nozzle 8, but without falling off.

Due to this high-energy measure, however, the natural oscillation at the resonance frequency $f_{res}$ is triggered in the printing system 11; in the illustrated example, the period $T_{res}=1/f_{res}$ of the resonant natural oscillation is approximately 15 μs.

The following pulses 22 for ejecting multiple ink drops 24 are subsequently produced in a certain time grid. Each following pulse 22 in FIG. 5 is made up of a falling edge, during which the ink volume V in the ink chamber 12 increases by a volume ΔV, where the following applies:

$$\Delta V = V_{drop}.$$

During a brief plateau phase 23 of the following pulse 22, ink flows from the ink reservoir 14 through the ink channel 13 into the ink chamber 12 of the printing system in question.

The diaphragm 16 subsequently swings back into its starting position, and the volume V within the ink chamber 12 decreases by ΔV. However, this quantity of ink corresponds to the volume $V_{drop}$ of an ink drop, and the ink drop ultimately falls off on the other side of the nozzle 8.

Such a "shot" period, during which ink is thus drawn into the ink chamber 12 and subsequently ejected through the nozzle 8 until the beginning of the next intake movement of the diaphragm 16, corresponds to the period $T_{res}$ of the natural oscillation of the printing system 11, so that each period begins at the same phase position of the natural oscillation.

In order for the period $T_{seq}$ of an overall pixel sequence to be at most approximately 50 μs, only three ink drops 24 maximum per pixel sequence may therefore be delivered. In addition, since the volume is approximately the same for all ink drops 24, accordingly the color intensity $I_F$ of a pixel may be changed only in a coarse grid, namely, in the steps $$I_F = 0^* I_0;$$

$$I_F = 1^* I_0;$$

$$I_F = 2^* I_0;$$

$$I_F = 3^* I_0;$$

where $I_0$ corresponds to the color intensity of a single colored drop of the size in question.

Thus, this involves a maximum of four different values, corresponding to a piece of information that is representable by 2 bits: 00=0; 01=1; 10=2; 11=3.

Although this might be normal for an inkjet printer, it does not represent a good result, since, for example, the intensity values of the pixels of images that are recorded by means of a camera have a much finer resolution, for example with 16 different color intensities per pixel and color (4 bits), or with 64 color intensities, or with 128 or even 256 color intensities.

Figure 6:
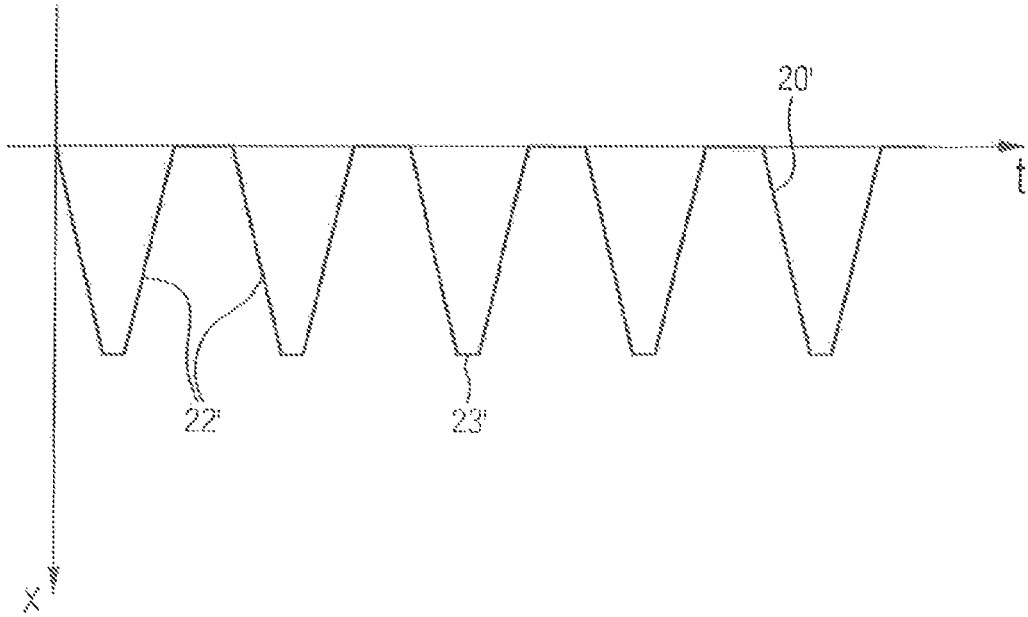
FIG. 6 shows the variation over time of the actuating signal according to the invention for the printing system according to FIG. 1.
Figure 7:
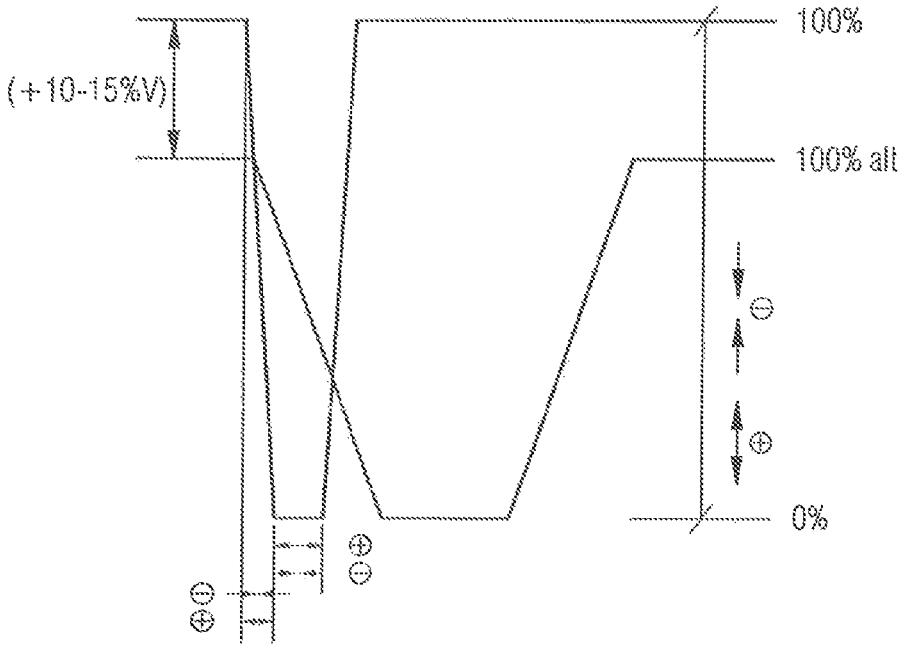
FIG. 7 shows the options for influencing the control signal for varying the drop size or the drop volume, where "+" corresponds to an increasing influence on the drop size, and "−" corresponds to a reducing influence.
Figure 8:
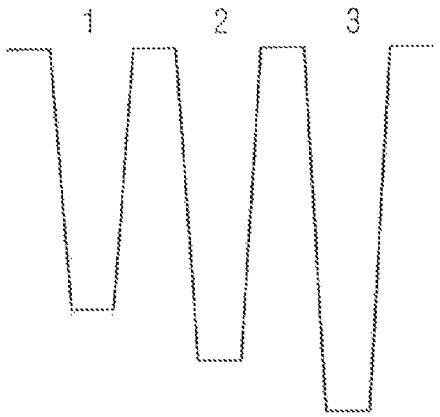
FIG. 8 shows a variation over time by way of example of a sequence of trigger pulses according to the invention, for illustrating the option of varying the ink quantity by overprinting multiple drops having different volumes.
Figure 9:
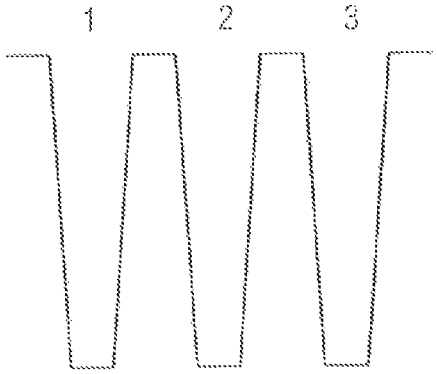
FIG. 9 shows a variation over time by way of example of a pixel sequence in the prior art, where all trigger pulses have the same size and length, so that all ink drops have the same volume.

In order to solve the above problems with regard to a limited printing speed and a very restricted resolution of the color intensity, with printing using inkjet printers, the invention, with an otherwise identical print head 1 and identical printing system 11, proposes the actuation method illustrated in FIG. 6.

This method is based on the concept of not subordinating to the natural oscillation of the printing system 11 with the resonance frequency $f_{res}$, but, rather, to avoid such, so that the system is not excited at all into its natural oscillation, and therefore each ink drop 24 does not have to be delivered synchronously with an oscillation of the printing system 11, and instead could theoretically be delivered at an arbitrary point in time.

The invention provides several measures for avoiding the natural oscillation of the printing system 11 with the resonance frequency $f_{res}$:

Firstly, in the method according to the invention an excitation pulse 21' that precedes the actual print pulse 22' is completely absent.

Therefore, in any case the first print pulse 22' encounters a diaphragm 16 at rest; defined conditions prevail in the printing system 11, and the first ink drop 24 is delivered with high precision.

Another measure for avoiding the natural oscillation is to shorten the plateau phase 23'. Whereas in the prior art, the time $T_{plat}$ of the plateau phase 23 is greater than the times $T_{rising}$, $T_{falling}$ for the rising or falling ramp, the following now applies:

$$T_{plat} < T_{rising}$$

$$T_{plat} < T_{falling}$$

This is achieved by increasing the maximum deflection $\Delta x_{max}$, with the slope of the rising and falling ramps remaining approximately constant. The time $T_{plat}$ required for drawing in the same ink volume $\Delta V$ may thus be shortened, since the flow velocity is increased due to a higher differential suction pressure between the ink chamber 12 and the ink reservoir 14.

Consequently, the following relationship may be achieved:

$$T_{falling}+T_{plat}+T_{rising}<T_{res}/4,$$

in particular $$T_{falling}+T_{plat}+T_{rising}<T_{res}/5.$$

As a result of this measure, the spectrum of such an individual wave is shifted toward higher frequencies, and thus has a much larger frequency spacing from the resonance frequency $f_{res}$. Consequently, the resonance frequency $f_{res}$ is not hereby triggered.

Another measure for avoiding resonant natural oscillations in the printing system 11 is to further reduce the duration of a period $T_{drop}$ for the ejection of an ink drop, in particular in such a way that the following applies:

$$T_{drop}\leq T_{res}/1.5.$$

As a result, in the spectrum there are no spectral components at $f_{res}$, and therefore there is also no excitation of natural oscillation.

Moreover, for a period duration of $T_{drop}=T_{res}/2$, for example, due to a following print pulse a natural oscillation of frequency $f_{res}$, possibly triggered beforehand, is once again quenched by an anticyclical phase position.

On the other hand, the period duration also should not become too short, so that successive ink drops 24 in the flight phase remain separate from one another and do not uncontrollably combine with one another during flight, since otherwise the size of the drop 24 drawn in from the nozzle 8 could differ from the desired volume. To ensure this, the invention recommends that the following inequality be observed:

$$T_{drop}\geq T_{res}/3.$$

Particularly suitable for the method according to the invention are such print heads 1 or printing systems 11 in which the movement of a diaphragm 15 that at least partially delimits the ink chamber 12 is brought about by a piezo element 16. The activity direction of the piezo element is usually oriented perpendicularly with respect to the diaphragm 15. However, there are various piezo print heads of this type that differ in particular with regard to the configuration of the diaphragm 15 and the piezo element 16 acting on it, relative to the position and longitudinal direction of the nozzle 8:

In the arrangement referred to in technical jargon as a "piston shooter," the diaphragm 15 is situated between the nozzle 8 and the piezo element 16, and the direction of action of the latter is in alignment with or parallel to the longitudinal direction of the nozzle 8.

In the so-called "side shooter," the diaphragm 15 is situated to the side of the ink chamber 12, next to the nozzle 8, so to speak. Whereas the diaphragm 15 may be parallel to the nozzle direction, the direction of action of the piezo element 16 is perpendicular to the longitudinal direction of the nozzle 8, and therefore an ejected drop 24 moves at an angle of 90° relative to the direction of action of the piezo element 16.

Furthermore, there is also the so-called "shared wall" arrangement, in which pressing by means of piezo elements 16 takes place from both sides against laterally situated diaphragms, preferably in opposite directions; however, the longitudinal direction of the nozzle 8 and the direction of a drop 24 exiting the nozzle are offset relative to one another by 90° with respect to the shared line of the directions of action of the piezo elements 16.

The invention provides a number of advantages:

The point in time of the firing signal is independent of a preliminary signal or an oscillation, since firing takes place when the frequency is quiescent. In any event, when the color intensity of zero is associated with a pixel, corresponding to no ink drop, a placeholder signal may be emitted which, similarly as for the preliminary signal generated in the prior art, is too weak in its intensity to bring about the triggering of a drop. Such a placeholder signal should be used only for the purpose of keeping the ink within the ink chamber 12 in a print-ready state, at an optimal viscosity, during phases of non-use. In addition, a residual natural oscillation from a preceding actuating signal may be quenched when the actuation takes place anticyclically, i.e., for $T_{drop}=T_{res}/2$.

By use of the method according to the invention, successive ink drops 24 having different drop sizes that are independent of one another may be achieved which do not influence each other.

The drop size in each case is a function only of

- the duration of the rising and/or falling edge of a print pulse (a more rapid edge results in a smaller drop size), and/or
- the overall duration of a print pulse (a shorter print pulse results in a smaller drop size), and/or
- the amplitude or magnitude of a print pulse (the drop is smaller at a smaller amplitude), and in each case conversely; i.e., larger drop sizes may be achieved by the respective opposite measure.

By varying the above parameters, it is possible, in a single sequence for creating a pixel by means of multiple print pulses, to eject multiple drops 24 having different sizes and volumes in order to achieve intermediate color intensity values.

In contrast, the drop size is a function of the nozzle diameter only to a limited extent, since the drop/meniscus during firing does not oscillate and is delimited by the nozzle wheel, and instead is a function strictly of the energy of the pulse. In the current prior art, the nozzle diameter is the determining element for the drop size.

In addition, in the invention the ejected drop 24 is very stable and precise.

The maximum drop speed becomes smaller; there are no undesirable satellite drops next to, in front, of behind the main drop.

With the method according to the invention, a much higher firing frequency is possible than in the prior art, at the same time with increasing precision and variable drop size. The frequency may be increased by approximately 100% to approximately 200%, and at the same time, finer gray graduations are achievable.

The savings are approximately 5 to 10% for printing with high-viscosity (ink) fluids.

LIST OF REFERENCE NUMERALS

1 inkjet print head
2 plate
3 fastening hole

4 fastening hole
5 end area
6 middle portion
7 flat side
8 nozzle
9 screw heads
10 flat side
11 printing system
12 ink chamber
13 ink channel
14 ink reservoir
15 diaphragm
16 piezo element
17 rear block
18 control circuit
19 supply voltage
20 graph
21 first pulse
22 following pulse
23 plateau phase
24 drop

The invention claimed is:

1. A method for actuating an inkjet print head (1), comprising at least one printing system (11) having a nozzle (8) on the side of an ink chamber (12) which faces a substrate to be imprinted, and which is delimited at least in areas, preferably in its area facing away from the print substrate, by a diaphragm (15) that is movable away from the ink chamber (12) by electrically actuating a piezo element (16) that is mechanically coupled to the diaphragm (15), so that ink is drawn into the ink chamber from an ink reservoir (14), and the diaphragm is movable toward or into the ink chamber so that an ink drop (24) is ejected from the ink chamber through the nozzle (8), wherein the printing system (11) made up of the ink chamber (12), diaphragm (15), piezo element (16), and the control circuit (18) thereof represents an oscillatable structure which, when actuated at high energy, is excited to oscillate at a natural frequency $f_{res}$ that exhibits resonance; i.e., the oscillation with the period $T_{res}=1/f_{res}$ undergoes little or no attenuation, and wherein the color intensity of a pixel to be printed is varied in that, for each pixel, a sequence of multiple ink drops (24) is ejectable in succession from the same nozzle (8) at a period $T_{drop}=1/f_{drop}$ for the ejection of an ink drop, characterized in that energy is only introduced into the printing system (11) via the actuation signal precisely when an ink drop (24) is actually to be ejected, wherein for the period $T_{drop}$ between (i) two subsequent printing control signals, and (ii) the oscillation period $T_{res}=1/f_{res}$ of the resonant natural frequency $f_{res}$ of the printing system (11), it applies:

$$T_{drop} \leq T_{res}/1.5.$$

2. The method according to claim 1, characterized in that the minimum period $T_{drop}$ between chronologically sequential print actuating signals is unequal to the oscillation period $T_{res}=1/f_{res}$ of the resonant natural frequency $f_{res}$ of the printing system (11):

$$T_{drop} \neq T_{res}.$$

3. The method according to claim 1, characterized in that the minimum period $T_{drop}$ between chronologically sequential print actuating signals is equal to or preferably greater than one-third of the oscillation period $T_{res}=1/f_{res}$ of the resonant natural frequency $f_{res}$ of the printing system (11):

$$T_{drop} \geq T_{res}/3.$$

4. The method according to claim 1, characterized in that the minimum period $T_{drop}$ between chronologically sequential print actuating signals is equal to or preferably greater than two-fifths of the oscillation period $T_{res}=1/f_{res}$ of the resonant natural frequency $f_{res}$ of the printing system (11):

$$T_{drop} \geq T_{res}/2.5.$$

5. The method according to claim 1, characterized in that the size or the volume of an ink drop (24) is increased by increasing the amplitude of a trigger pulse.

6. The method according to claim 1, characterized in that the size or the volume of an ink drop (24) is increased by increasing the overall duration of a trigger pulse or the duration of the plateau phase of a trigger pulse.

7. The method according to claim 1, characterized in that the size or the volume of an ink drop (24) is increased by increasing the duration of the rising and/or falling edge of a trigger pulse.

8. The method according to claim 1, characterized in that the size or the volume of an ink drop (24) is not a function of the duration or of other properties of a preceding trigger pulse.

9. The method according to claim 1, characterized in that the sizes of the ink drops (24) of a pixel sequence to be printed are different and/or independent from one another.

10. The method according to claim 1, characterized in that the series of different drop sizes is nonlinear.

11. The method according to claim 1, characterized in that in any event for a pixel having an associated color intensity of zero, corresponding to no ink drop, a placeholder signal is emitted which, however, is too weak in its intensity to bring about the triggering of a drop; however, if the color intensity of zero is not associated with a pixel, corresponding to one or multiple ink drops, a nonprinting preliminary signal or intermediate signal is not present either in front of or between the trigger pulses of this pixel sequence.

12. A method for actuating an inkjet print head (1), comprising at least one printing system (11) having a nozzle (8) on the side of an ink chamber (12) which faces a substrate to be imprinted, and which is delimited at least in areas, preferably in its area facing away from the print substrate, by a diaphragm (15) that is movable away from the ink chamber (12) by electrically actuating a piezo element (16) that is mechanically coupled to the diaphragm (15), so that ink is drawn into the ink chamber from an ink reservoir (14), and the diaphragm is movable toward or into the ink chamber so that an ink drop (24) is ejected from the ink chamber through the nozzle (8), wherein the printing system (11) made up of the ink chamber (12), diaphragm (15), piezo element (16), and the control circuit (18) thereof represents an oscillatable structure which, when actuated at high energy, is excited to oscillate at a natural frequency $f_{res}$ that exhibits resonance; i.e., the oscillation with the period $T_{res}=1/f_{res}$ undergoes little or no attenuation, and wherein the color intensity of a pixel to be printed is varied in that, for each pixel, a sequence of multiple ink drops (24) is ejectable in succession from the same nozzle (8) at a period $T_{drop}=1/f_{drop}$ for the ejection of an ink drop, characterized in that energy is only introduced into the printing system (11) via the actuation signal precisely when an ink drop (24) is actually to be ejected, wherein for the period $T_{drop}$ between (i) two subsequent printing control signals, and (ii) the oscillation period $T_{res}=1/f_{res}$ of the resonant natural frequency $f_{res}$ of the printing system (11), it applies:

$$T_{drop} \leq T_{res}/1.75.$$

13. A method for actuating an inkjet print head (1), comprising at least one printing system (11) having a nozzle (8) on the side of an ink chamber (12) which faces a substrate to be imprinted, and which is delimited at least in areas, preferably in its area facing away from the print substrate, by a diaphragm (15) that is movable away from the ink chamber (12) by electrically actuating a piezo element (16) that is mechanically coupled to the diaphragm (15), so that ink is drawn into the ink chamber from an ink reservoir (14), and the diaphragm is movable toward or into the ink chamber so that an ink drop (24) is ejected from the ink chamber through the nozzle (8), wherein the printing system (11) made up of the ink chamber (12), diaphragm (15), piezo element (16), and the control circuit (18) thereof represents an oscillatable structure which, when actuated at high energy, is excited to oscillate at a natural frequency $f_{res}$ that exhibits resonance; i.e., the oscillation with the period $T_{res}=1/f_{res}$ undergoes little or no attenuation, and wherein the color intensity of a pixel to be printed is varied in that, for each pixel, a sequence of multiple ink drops (24) is ejectable in succession from the same nozzle (8) at a period $T_{drop}=1/f_{drop}$ for the ejection of an ink drop, characterized in that energy is only introduced into the printing system (11) via the actuation signal precisely when an ink drop (24) is actually to be ejected, wherein for the period $T_{drop}$ between (i) two subsequent printing control signals, and (ii) the oscillation period $T_{res}=1/f_{res}$ of the resonant natural frequency $f_{res}$ of the printing system (11) on the other hand, it applies:

$$T_{drop} \leq T_{res}/2.$$

* * * * *